US009181079B2

(12) United States Patent
Gaudet

(10) Patent No.: US 9,181,079 B2
(45) Date of Patent: Nov. 10, 2015

(54) ADJUSTABLE HORSE BIT

(71) Applicant: Marieke Gaudet, Long Beach, CA (US)

(72) Inventor: Marieke Gaudet, Long Beach, CA (US)

( * ) Notice: Subject to any disclaimer, the term of this patent is extended or adjusted under 35 U.S.C. 154(b) by 123 days.

(21) Appl. No.: 13/902,768

(22) Filed: May 24, 2013

(65) Prior Publication Data

US 2013/0312375 A1 Nov. 28, 2013

Related U.S. Application Data

(60) Provisional application No. 61/652,274, filed on May 28, 2012.

(51) Int. Cl.
*B68B 1/06* (2006.01)

(52) U.S. Cl.
CPC ..... *B68B 1/06* (2013.01)

(58) Field of Classification Search
CPC ..... B68B 1/04; B68B 1/06
USPC ..... 54/6.1, 6.2, 7–9
IPC ..... B68B 1/04, 1/06
See application file for complete search history.

(56) References Cited

U.S. PATENT DOCUMENTS

| | | | | |
|---|---|---|---|---|
| 356,942 | A | 2/1887 | Johnston | |
| 435,252 | A * | 8/1890 | Sloat | 54/7 |
| 570,312 | A | 10/1896 | Kiehl | |
| 574,058 | A | 12/1896 | Bates | |
| 720,689 | A | 2/1903 | Hall et al. | |
| 813,337 | A * | 2/1906 | Weathers | 54/7 |
| 841,007 | A * | 1/1907 | Fretwell | 54/9 |
| 1,128,631 | A | 2/1915 | Smith | |
| 2,512,244 | A | 8/1945 | Wolfe | |
| 2,810,250 | A | 7/1955 | Smith | |
| 3,628,308 | A * | 12/1971 | Lozier | 54/8 |
| 3,751,877 | A * | 8/1973 | Morgan | 54/6.1 |
| 4,745,733 | A | 5/1988 | Berk | |
| 4,798,043 | A * | 1/1989 | Wyse | 54/6.1 |
| 4,965,987 | A | 10/1990 | Berk | |
| 6,553,747 | B1 * | 4/2003 | Texel | 54/6.1 |
| D523,997 | S | 6/2006 | Weyand | |
| 7,513,094 | B2 | 4/2009 | Denney et al. | |

FOREIGN PATENT DOCUMENTS

| | | |
|---|---|---|
| GB | 191200880 | 8/1912 |
| GB | 144917 | 6/1920 |
| GB | 1481262 | 7/1977 |
| GB | 24218888 | 7/2005 |

* cited by examiner

*Primary Examiner* — Lisa Tsang
(74) *Attorney, Agent, or Firm* — Cislo & Thomas, LLP

(57) ABSTRACT

An adjustable horse bit that acts as a snaffle bit (direct-pressure) under normal circumstances and transforms into an elevator bit (leverage bit) when a threshold force is applied to a hingedly attached lever section of the horse bit cheek piece. Absent the threshold force, the lever section retracts to transform the elevator bit back to a snaffle bit.

16 Claims, 10 Drawing Sheets

ADJUSTABLE HORSE BIT

CROSS-REFERENCE TO RELATED APPLICATION

This patent application claims the benefit of U.S. Provisional Patent Application Ser. No. 61/652,274, entitled "Adjustable Horse Bit," filed May 28, 2012, which applications are incorporated in their entirety here by this reference.

TECHNICAL FIELD

This invention relates to a horse bit for use with a horse to connect the reins to the mouth of the horse for the purpose of controlling the horse, and more particularly a convertible horse bit that transforms between a snaffle bit and an elevator bit in response to horse behavior and the amount of force the horse and rider exert on the bit and the reins. The bit is equipped with a pair of segmented cheek pieces, where the segments are hingedly attached to each other and connected by a spring mechanism acting on the pivot, allowing one of the cheek piece segments to rotate and pivot about the hinge, extending from a snaffle position into an elevator bit lever when the horse pulls on the reins.

BACKGROUND

Through the ages there has been a need to control horses, mules, and donkeys. The development of control devices has resulted in the now familiar tack arrangement of a horse bit and a bridle. The bit, including a mouthpiece, is adapted to fit in the animal's mouth and extend over and atop its tongue, and a set of reins which are attached to the bit at either side of the animal's mouth via cheek pieces and cheek piece attachment points. The bridle is comprised of straps, which adjustably fit around the animal's head. A crown piece, brow band, and noseband secure the bridle to the top of the animal's head. Generally two pairs of straps are attached to the bit at the left and right side of the bit, first a pair of cheek bridle pieces comprises straps connecting the crown piece, brow band, and nose band to the bit, and second, a set of reins are connected to the bit and configured to hang around the animal's neck.

The use of horse bits for controlling horses, riding and driving, is known in the prior art. Several horse bit configurations are known. The horse bit is used to communicate with and control a horse by applying pressure to the horse's mouth. The bit mouthpiece generally rests in an open space between the horse's teeth where the horse's gums are exposed and the bit includes at least a pair of rings (bit cheek pieces attachment points) for securing the reins and the bridle cheek pieces to the bit. The bit cheek pieces may include additional attachment points (rings) or extensions. When pulling on the reins, a rider applies pressure to the bit, applying pressure to the animal's mouth, and thereby communicates a command to the horse. The bit is formed so that the bit does not damage the horse's gums or other areas of the horse's mouth when the rider applies pressure thereto.

Typically, bits are categorized as either direct-pressure bits, such as a snaffle bit, or leverage bits (elevator or curb bits). Both types of bits have in common a bit bar (mouthpiece), which may be constructed in one or multiple pieces, where in the latter case, the bit bar pieces are interconnected by means of an articulation or chain, such as a curb chain attached to an upper attachment point of each cheek piece. The mouthpiece ends are attached to the bit cheek pieces, which provide for the attachment of the bridle via attachment of the cheek piece ends and the reins. The bit, typically a leverage bit, may further comprise elongated bit cheek pieces which extend toward the front of the animal's mouth, and where the reins are attached to the ends thereof, allowing for exertion of greater torque on the animal's mouth. The pivoting action takes place about the attachment point of the bridle cheek pieces and the bit cheek pieces and the torque excreted on the animal's mouth for a given pull from the rider is proportional to the length of the extension (radius), where a longer extension corresponds to a larger torque: $\tau = r*F$ (torque ($\tau$) equals the multiple of the length of the lever (r) and the sum force (F) excreted on the lever).

It is generally accepted that depending on the temperament, there are advantages and benefits in selecting a direct-pressure bit or a leverage bit for any specific horse. Because it applies less torque and pressure to the horse, a direct-pressure bit may be advantageous with a calmer horse, while a leverage bit may be more appropriate for a horse needing additional control. A snaffle bit is generally good choice for introducing young horses to the fundamentals, but it can be used on any horse that would benefit from direct rein contact. A leverage bit may make it easier for a horse to perceive subtler rein cues, where for a given rider input the horse feels a greater force from the rider's input than it would with a direct pressure bit. Also, in certain riding styles in the western United States, riders prefer one-handed control of the reins and prefer a leverage bit.

Because of the different preferences in style, and the benefits of the different types of bits in different situations, it would be useful to have a horse bit that could automatically adjust between a direct-pressure bit and a leverage bit based on the situation. Current solutions disclose several adjustable-leverage bit designs that require that the length of the elongation of the lever be mechanically adjusted and fixed so as to provide a desired leverage corresponding to a fixed length. Other solutions also disclose adjustable direct-pressure bits and leverage bits that are of a curb design with a fixed mouthpiece attachment and a chain attachment that can cause pinching and creates an environment for the horse to become afraid or sensitive to the potential pain it may experience in the pinch points. These solutions do not allow on the fly adjustments to suit the preferences of the horse or the rider.

For the foregoing reasons there is a need for an adjustable horse bit that acts as a direct-pressure bit under normal circumstances, acts as a leverage bit if a threshold force is applied, and is safe and adjustable without hurting the horse.

SUMMARY

The present invention is directed to an adjustable horse bit that acts as a direct-pressure horse bit under normal circumstances but transforms into a leverage bit when the horse and rider exert a certain threshold force, returning to a direct-pressure horse bit when the threshold force is removed. The embodiments employ a segmented cheek piece configured with a hinged attachment for the cheek piece segments, and a retracting means to shorten the elongation absent a threshold force (pulling action of the animal and rider). A first position, such as a closed configuration, uses a loose ring snaffle action that has motion and encourages relaxation and self carriage. A second position, such as an open configuration, uses an elevator action which does not change the shape or action within the horse's mouth.

It is a goal of the present invention to have a traditional horse bit design to appeal to equestrians, while being flexible and adjustable for different circumstances and the different preferences of horses and riders.

BRIEF DESCRIPTION OF DRAWINGS

FIG. 5(*b*) shows an adjustable horse bit cheek piece in an open position; FIG. 6(*b*) shows an adjustable horse bit cheek piece configured with a locking mechanism located at the cheek hinge; and FIG. 7(*a*) and FIG. 7(*b*) show a closed position and an open position of an adjustable horse bit cheek piece with a protective enclosure over the retracting means; FIG. 9(*b*) illustrates an adjustable horse bit in a second position with bridle and reins, where the reins are attached at the higher set of lower attachment points; FIG. 10(*b*) illustrates an adjustable horse bit in a second position with bridle and reins, where the reins are attached at the lower set of lower attachment points.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
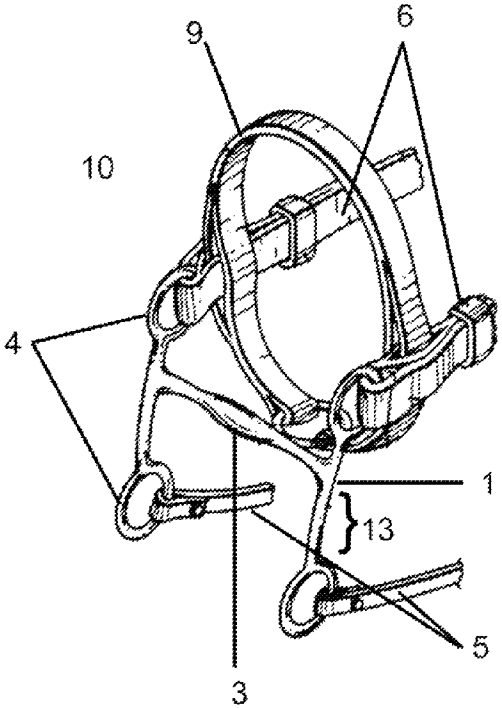
Fig. 1 Prior Art
FIG. 1 shows a sample curb bit configured with a bridle and reins.

FIGS. 1 through 4 demonstrate the prior art. FIG. 1 shows a sample horse bit 1 with a bridle 10 and reins 5. This particular horse bit 1 is a curb bit, which has a mouthpiece 3, attachment points 4, and levers 13. The bridle 10 consists of bridle cheek pieces 6, crown piece 7, brow band 8, and nose band 9. The bridle cheek pieces 6 attach to the horse bit 1 at the upper attachment points 4.

Figure 2:
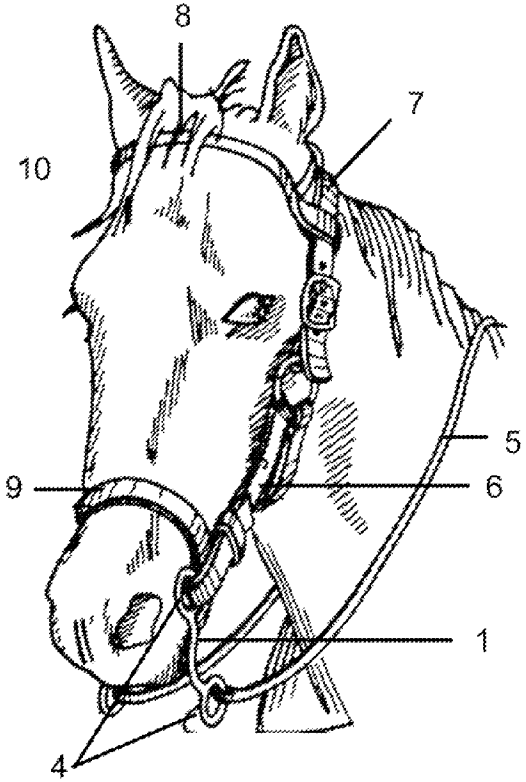
Fig. 2 Prior Art
FIG. 2 shows a horse wearing a bit, bridle, and reins.

FIG. 2 demonstrates sample horse bit 1 with bridle 10 and reins 5 as it is used on a horse. The bridle 10 is configured around the horse's head. The horse bit 1 is attached to the bridle with the mouthpiece 3 inside the horse's mouth. The reins 5 are attached to the horse bit 1 at the attachment points 4 and are pulled to apply pressure on the horse.

Figure 3A:
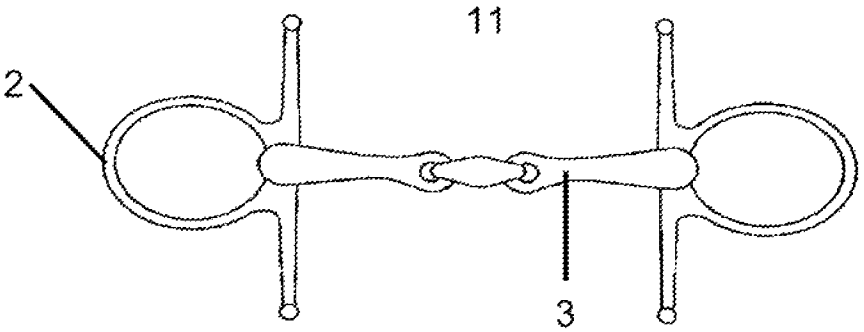
Fig. 3(a) Prior Art
FIG. 3(*a*) and FIG. 3(*b*) show several variations of snaffle bits.
Figure 3B:
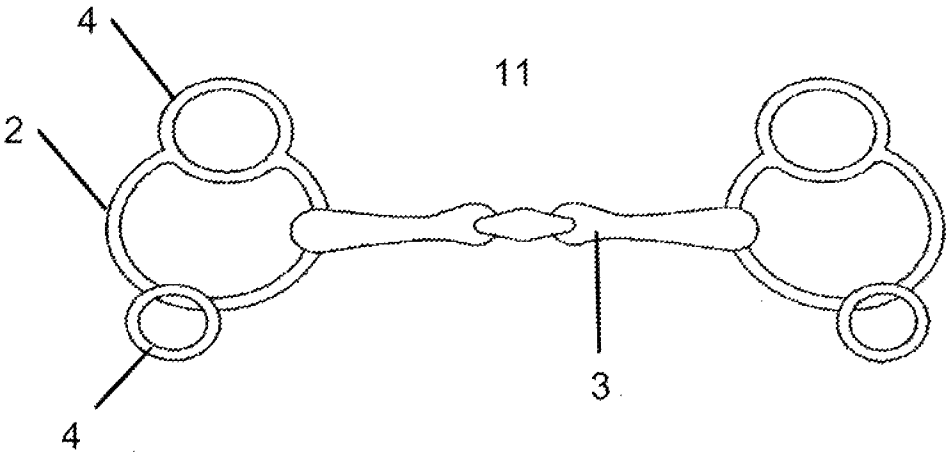
Fig. 3(b) Prior Art

FIG. 3(*a*) and FIG. 3(*b*) show examples of direct pressure bits 11, which are also called snaffle bits. Direct pressure bits generally consist of a mouthpiece 3, cheek pieces 2, and attachment points 4. The mouthpiece can be of any number or variety of types, shapes, and pieces.

Figure 4:
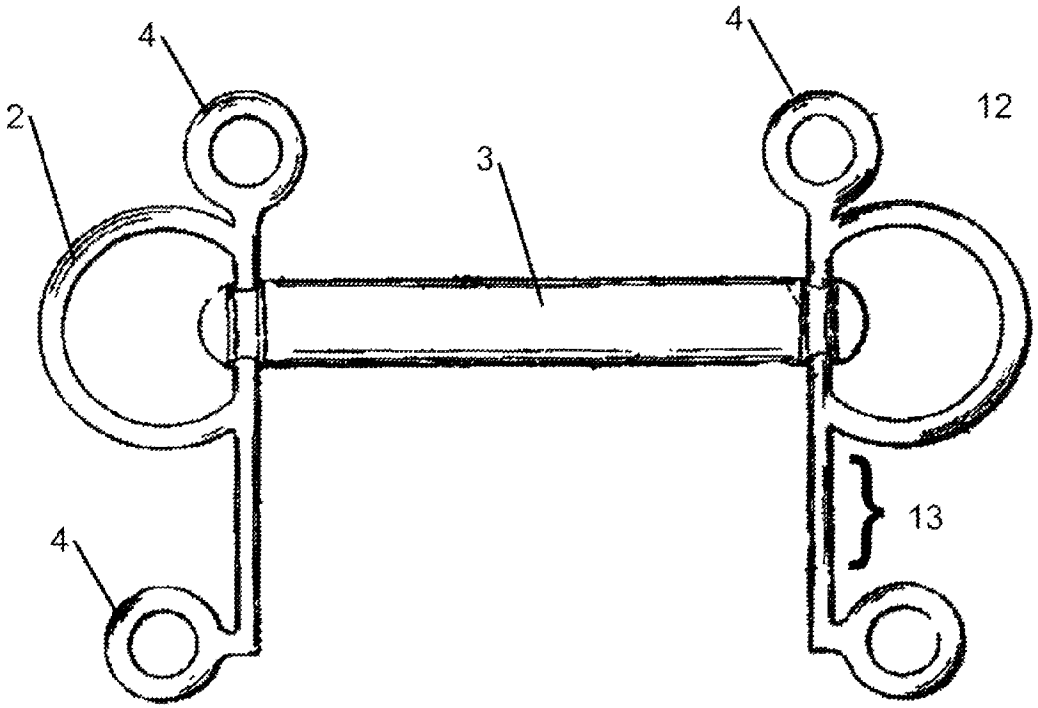
Fig. 4 Prior Art
FIG. 4 shows a typical curb bit.

FIG. 4 shows an example of a leverage bit 12. This example is a curb bit, which is different from an elevator bit. A curb bit generally has a mouthpiece 3, cheek pieces 2, attachment points 4, and levers 13. The torque applied by curb bits is based on the length of the elongation of the lever 13, and the force of the reins and horse. Curb bits apply pressure to the mouth, poll, and chin groove.

Figure 5B:
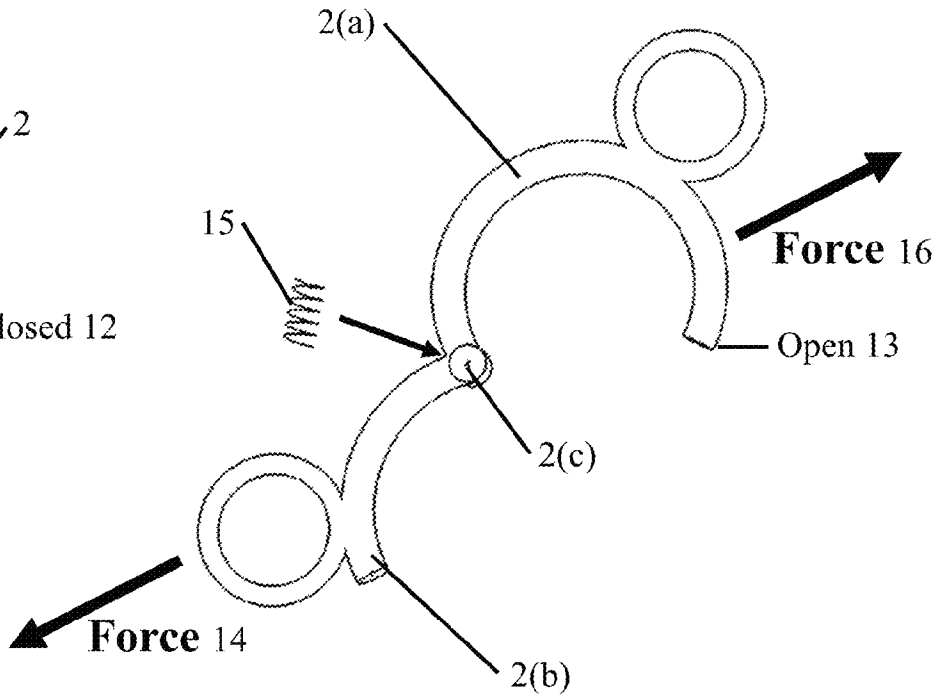
FIG. 5(*a*) shows an adjustable horse bit cheek piece in a closed position.
Figure 5A:
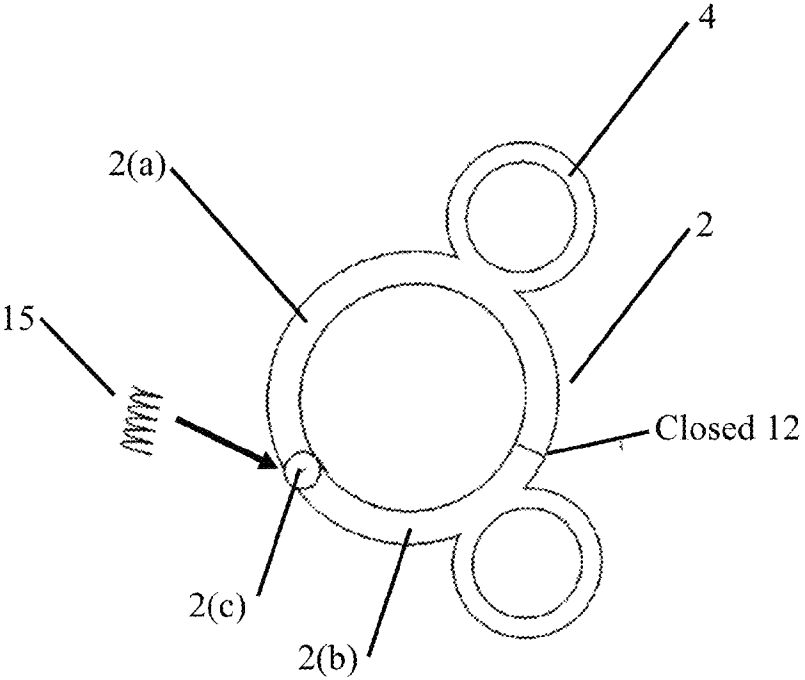

The present invention is an adjustable horse bit that acts as a normal direct-pressure horse bit in normal situations, and extends into a leverage bit when a horse and rider are exerting a threshold force to allow the rider increased control over a horse. FIGS. 5(*a*) and 5(*b*) show the cheek pieces 2 of the adjustable horse bit in a first position for direct-pressure action and a second position for leverage action. The cheek pieces consist of upper and lower attachment points 4, and a central cheek piece that consists of a cheek pivot 2(*a*) which does not move, a cheek hinge 2(*c*) connected to the cheek pivot 2(*a*), and a cheek lever 2(*b*) which is attached to the cheek hinge 2(*c*) and can move to create a second position as in FIG. 5(*b*). The retracting means, in this case a spring 15, biases the cheek piece to a first position as in FIG. 5(*a*). If a horse is pushing forward, he applies a force 16 to the cheek pivot. If a rider pulls on his reins 5, force 14 is applied to the lower attachment point 4, which rotates the cheek lever and forces the cheek piece into a second position.

When in a first position, the horse bit 1 acts as a direct-pressure bit, like a snaffle bit. When in a second position, the horse bit 1 acts as a leverage bit. In the preferred embodiment, this position most closely resembles that of an elevator bit.

Figure 6B:
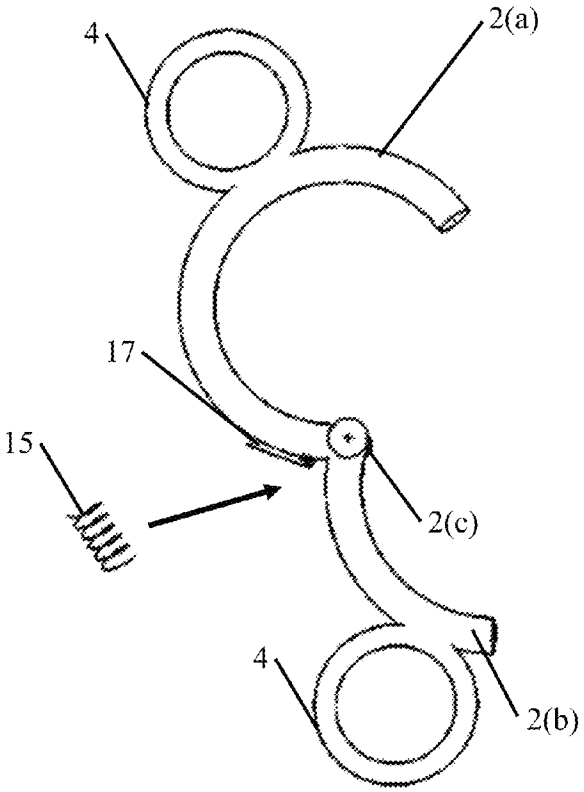
FIG. 6(*a*) shows an adjustable horse bit cheek piece configured with a locking mechanism located opposite of the cheek hinge.
Figure 6A:
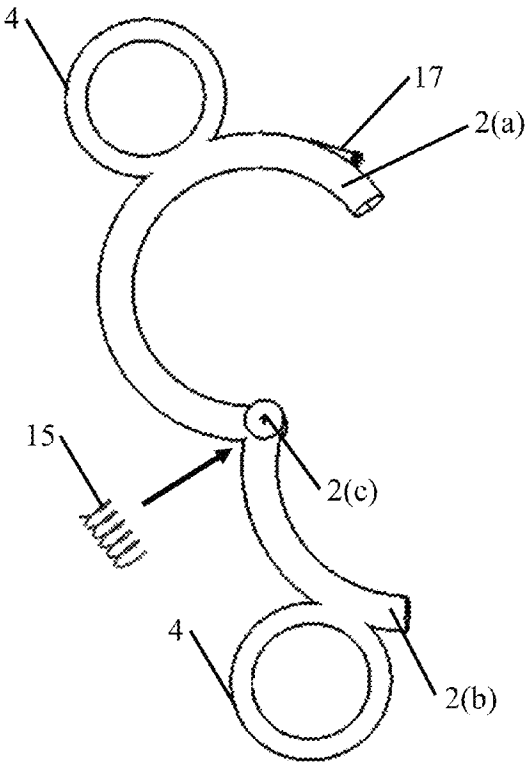

In cases where a rider prefers only one of the positions, a locking mechanism can be used to prevent the transformation between a second position and first position. FIG. 6(*a*) and FIG. 6(*b*) show an embodiment where a locking mechanism 17 is part of the horse bit 1. When the locking mechanism 17 is engaged, the horse bit 1 will stay in a second position if it is already open, or a first position if it is already closed. This can be used in situations where a rider wishes to keep the horse bit 1 in one position to control the horse in a specific way. The locking mechanism 17 in FIG. 6(*a*) locks the hinge to prevent rotation. The locking mechanism 17 in FIG. 6(*b*) locks the ends of the cheek pivot 2(*a*) and cheek lever 2(*b*) to prevent separation.

Figures 7A, 7B, 8:
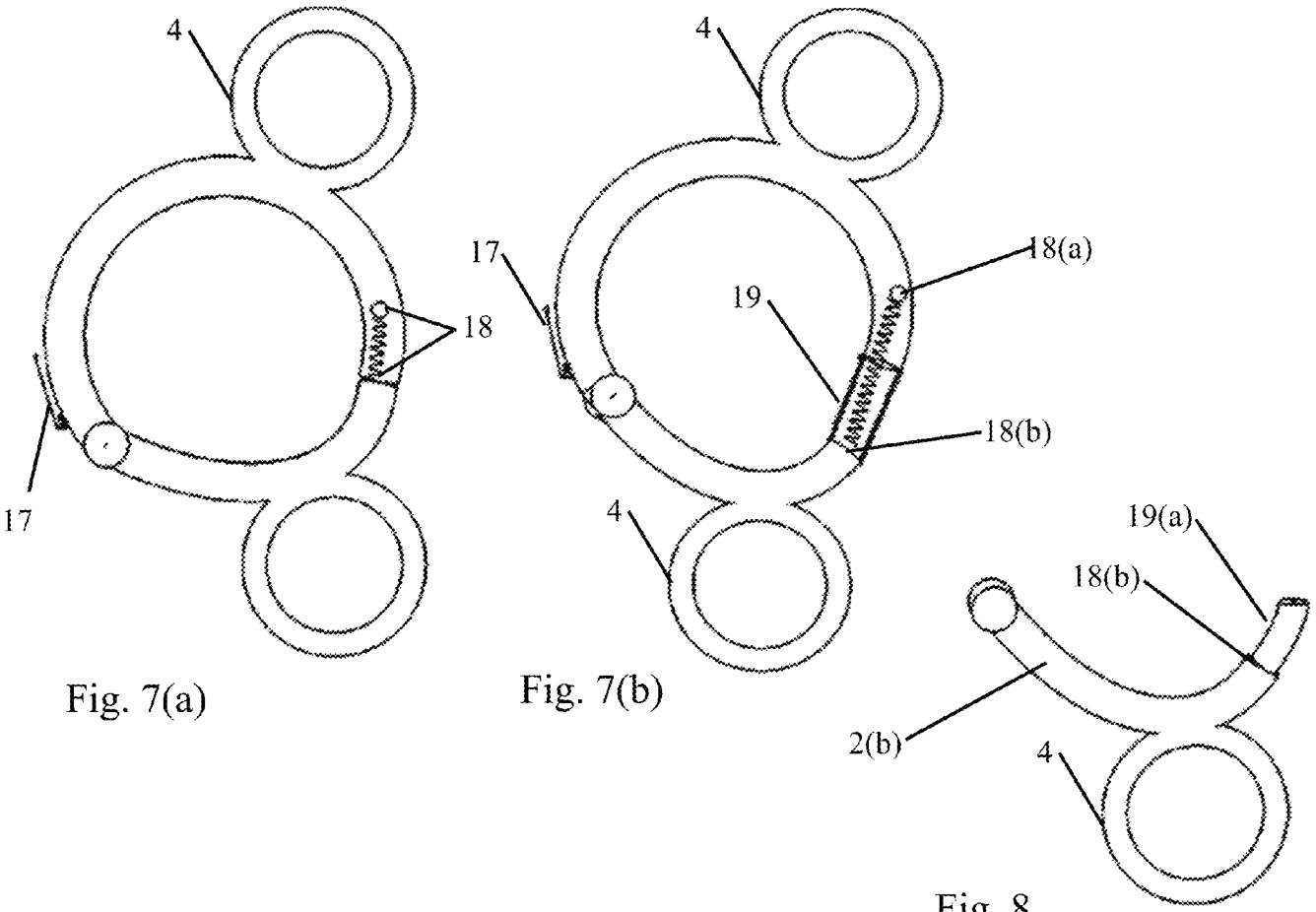
FIG. 8 shows a cheek lever for use with an adjustable horse bit configured with a tube shaft to shield the retracting means opposite from the cheek pivot.

It may also be preferable to hide or protect the retracting means. FIG. 7(*a*) and FIG. 7(*b*) show an embodiment where the horse bit also has a protective enclosure 19 over the retracting means. In this embodiment, the protective enclosure is a tube shaft 19(*a*) and the retracting means is a spring 15 that is located within the cheek piece 2. The spring 15 is attached to the cheek pivot at the spring attachment point 18(*a*). The spring 15 is attached to the cheek lever at the spring attachment point 18(*b*). The tube shaft 19 prevents the spring 15 from being exposed. FIG. 8 shows an embodiment where the tube shaft 19(*a*) is fixed to the spring attachment point 18(*b*) and cheek lever 2(*b*).

Figure 9B:
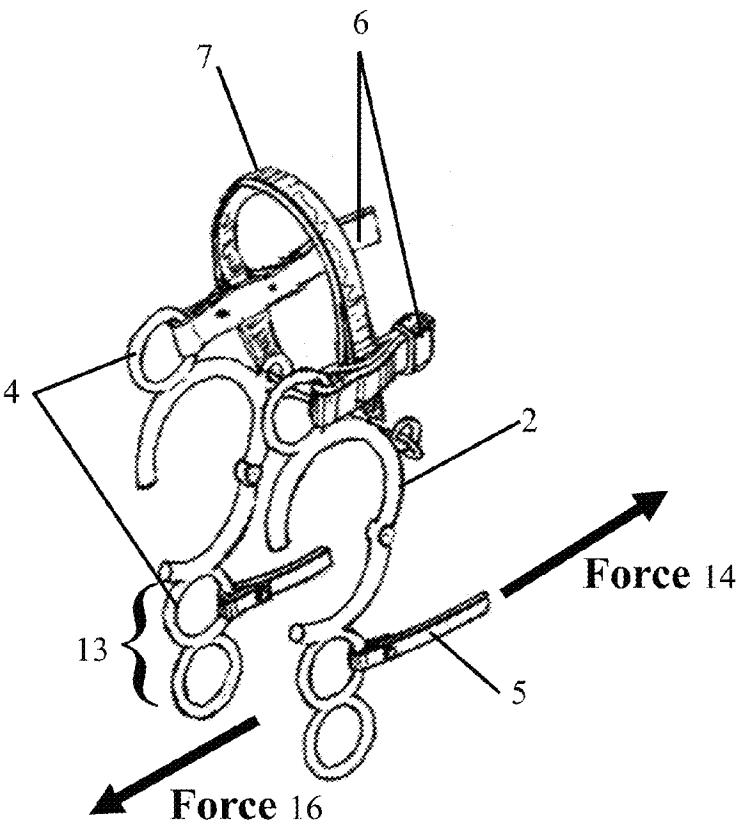
FIG. 9(*a*) illustrates an adjustable horse bit in a first position with bridle and reins, where the reins are attached at the higher set of lower attachment points.
Figure 9A:
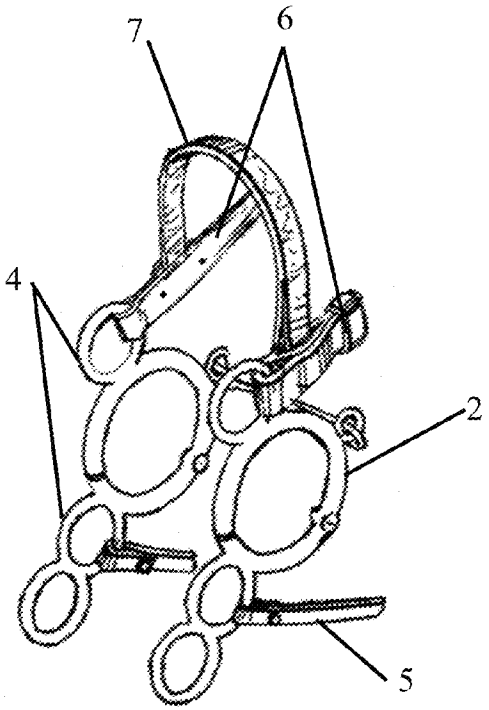
Figure 10B:
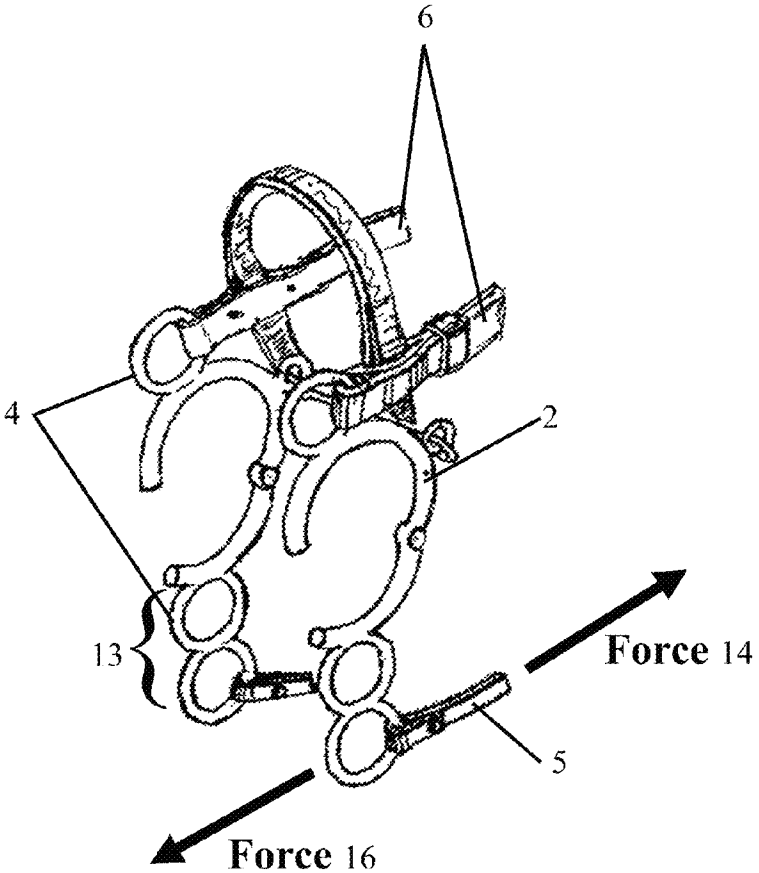
FIG. 10(*a*) illustrates an adjustable horse bit in a first position with bridle and reins, where the reins are attached at the lower set of lower attachment points.
Figure 10A:
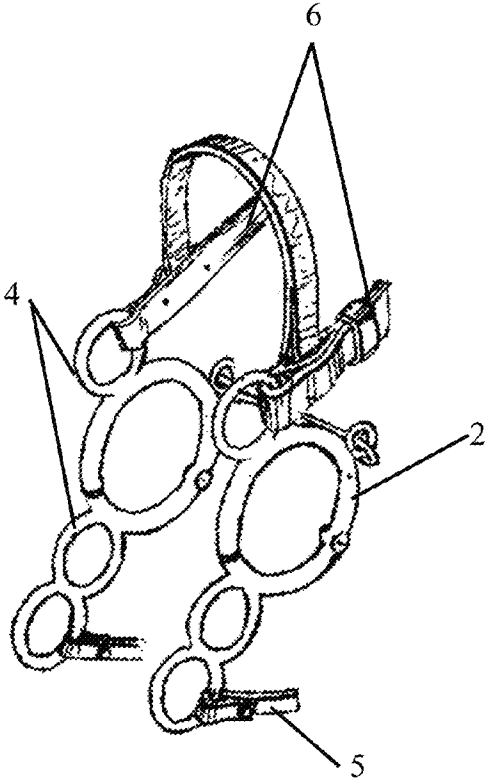
Figure 11B:
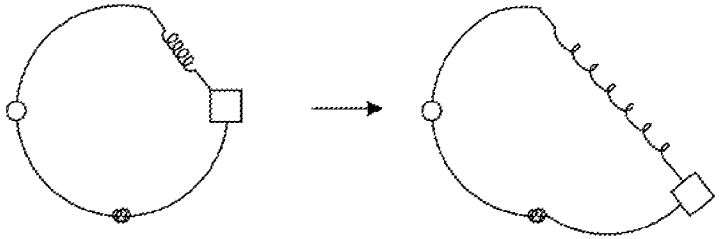
FIGS. 11(*a*)-(*d*) show different configurations of retracting means.
Figure 11D:
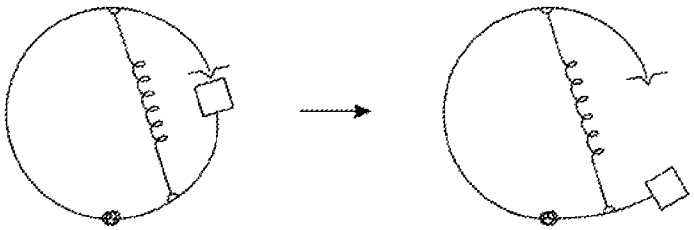
Figure 11A:
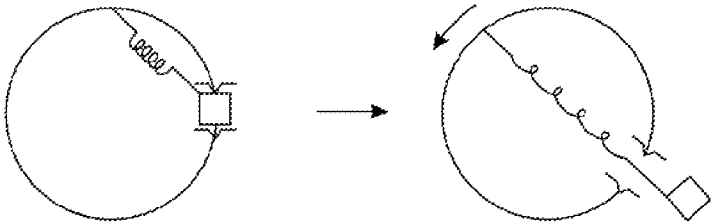
Figure 11C:
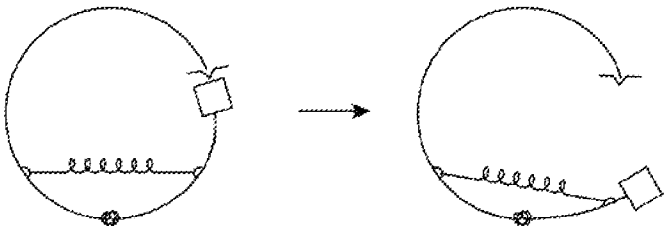

In addition to wanting to change from a direct-pressure bit to a leverage bit, a rider may want to increase or decrease the magnitude of the lever action. FIG. 9(*a*), FIG. 9(*b*), FIG. 10(*a*), and FIG. 10(*b*) show the adjustable horse bit with bridle 10 and reins 5. The reins attach on the lower attachment points, but the rider has the option of choosing which set of lower attachment points to use. If the reins 5 are attached to the lower attachment points further away from the central cheek piece as in FIG. 10(*a*) and FIG. 10(*b*), the rider can apply more torque than if the reins are attached to the lower attachment points closer to the central cheek piece as in FIG. 9(*a*) and FIG. 9(*b*). Thus, the magnitude of the lever action can be adjusted by changing which attachment points the reins are connected.

There are many variations on how to implement the retracting means. FIGS. 11(*a*)-(*d*) show several of those different configurations. In FIG. 11(*a*), the spring 15 activates in a straight manner, reducing torque and spring design considerations. In FIG. 11(*b*), the spring 15 attaches from the end of the cheek pivot 2(*a*) to the end of the cheek lever 2(*b*). In FIG. 11(*c*), the spring 15 attaches from the spring pivot 2(*a*) to the spring lever 2(*b*) in such a manner so as to allow it to freely adjust for rotational type movement about the cheek hinge 2(*c*). In FIG. 11(*d*), the spring is attached at the top of the spring pivot 2(*a*) to the cheek lever 2(*b*).

Figure 12:
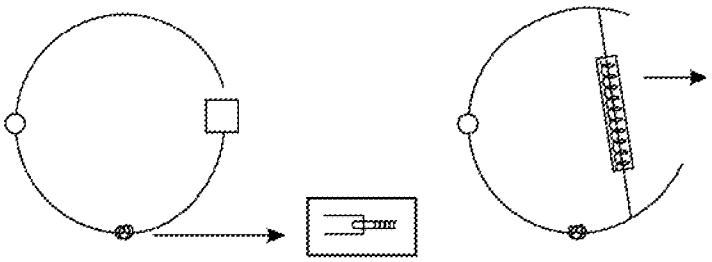
FIG. 12 shows embodiments of a twisting element that can be used to increase or decrease tension in the retracting means.

In some embodiments, a rider may wish to adjust the retracting means to increase or decrease tension based on the sensitivity or training needs of the horse or the skill level of the rider. FIG. 12 shows embodiments of a twisting element that can be used to tighten or loosen the retracting means to increase or decrease tension.

Figure 13:
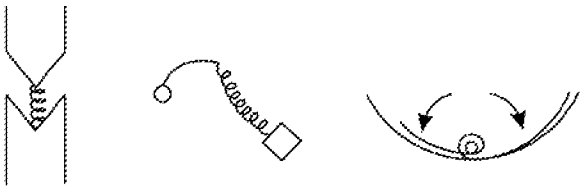
FIG. 13 shows several embodiments of the retracting means.

FIG. 13 shows several more embodiments of retracting means. The first image shows a compressional spring 15 or composite material to prevent easy opening of the cheek hinge 2(*c*). The second image shows a simple extensional coil or hydraulic spring. The third shows a simple coil set about a cheek hinge 2(*c*) to prevent free separation of the lever arm from the bit. The different configurations will alter the threshold force necessary to transform the direct-pressure bit to a leverage bit.

It is envisioned and it will be obvious to those of ordinary skill in the art that the embodiments may be applied to several types of leverage bits to temporarily extend the lever length and provide additional torque in response to the animals behavior. Further, it is well known that there are hundreds of bit and bridle configurations and herein described embodiments are configurable for use with such embodiments.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A horse bit configured to transform from a direct pressure bit into a leverage bit when a threshold force is applied to cheek pieces, comprising:

a. a mouthpiece;

b. a pair of cheek pieces, wherein each cheek piece comprises a central cheek piece connected to the mouthpiece, an upper attachment point connected to a top of the central cheek piece to connect to a bridle cheek piece, at least one lower attachment point connected to a bottom of the central cheek piece to connect to reins, wherein the central cheek piece comprises a cheek pivot hingedly attached to a cheek lever that allows the cheek piece to be in a first position or a second position;

c. a spring that biases the cheek piece to the first position, wherein the spring is attached from the cheek pivot to the cheek lever; and d. a tube shaft that acts as a protective enclosure for the spring;

wherein the cheek piece when in the first position is a loose ring snaffle;

wherein the cheek piece when in the second position is an elevator bit;

wherein the central cheek piece further comprises a locking mechanism that can lock the cheek piece in the first position or the second position.

2. The horse bit of claim 1, wherein the spring further comprises a twisting element to alter a tension of the spring.

3. The horse bit of claim 1, further comprising a curb chain connected to the upper attachment point of each cheek piece.

4. The horse bit of claim 1, wherein the at least one lower attachment point is two lower attachment points.

5. A horse bit configured to transform from a direct pressure bit into a leverage bit when a threshold force is applied to cheek pieces, comprising:

a. a mouthpiece;

b. a pair of cheek pieces, wherein each cheek piece comprises i. a central cheek piece connected to the mouthpiece, ii. an upper attachment point connected to a top of the central cheek piece to connect to a bridle cheek piece, iii. at least one lower attachment point connected to a bottom of the central cheek piece to connect to reins, iv. wherein the central cheek piece comprises a cheek pivot hingedly attached to a cheek lever that allows the cheek piece to be in a first position or a second position, v. a retracting means that biases the central cheek piece to the first position, vi. wherein the cheek piece when in the first position is a loose ring snaffle, and vii. wherein the cheek piece when in the second position is an elevator bit; and c. a locking mechanism that can lock the cheek piece in the first position or the second position.

6. The horse bit of claim 5, wherein the retracting means is a spring.

7. The horse bit of claim 6, wherein the spring further comprises a twisting element to alter a tension of the spring.

8. A horse bit configured to transform from a direct pressure bit into a leverage bit when a threshold force is applied to cheek pieces, comprising:

a. a mouthpiece;

b. a pair of cheek pieces, wherein each cheek piece comprises i. a central cheek piece connected to the mouthpiece, ii. an upper attachment point connected to a top of the central cheek piece to connect to a bridle cheek piece, iii. at least one lower attachment point connected to a bottom of the central cheek piece to connect to reins, iv. wherein the central cheek piece comprises a cheek pivot hingedly attached to a cheek lever that allows the cheek piece to be in a first position or a second position, v. a retracting means that biases the central cheek piece to the first position, and vi. wherein the cheek piece when in the first position is a loose ring snaffle; and c. a locking mechanism that can lock the cheek piece in the first position or the second position.

9. The horse bit of claim 8, wherein the retracting means is a spring.

10. The horse bit of claim 9, wherein the spring further comprises a twisting element to alter a tension of the spring.

11. The horse bit of claim 10, further comprising a protective enclosure around the retracting means.

12. The horse bit of claim 10, further comprising a curb chain connected to the upper attachment point of each cheek piece.

13. The horse bit of claim 12, wherein the at least one lower attachment point is two lower attachment points.

14. A horse bit cheek piece configured to transform from a direct pressure bit cheek piece into a leverage bit cheek piece when a threshold force is applied to the horse bit cheek pieces, comprising:

a. a central cheek piece;

b. an upper attachment point connected to a top of the central cheek piece to connect to a bridle cheek piece;

c. at least one lower attachment point connected to a bottom of the central cheek piece to connect to reins, wherein the central cheek piece comprises a cheek pivot hingedly attached to a cheek lever that allows the horse bit cheek piece to be in a first position or a second position;

d. a retracting means that biases the central cheek piece to the first position;

e. wherein the horse bit cheek piece when in the second position is an elevator bit;

f. a locking mechanism that can lock the cheek piece in the first position or the second position;

g. wherein the cheek piece when in the first position is a loose ring snaffle; and h. wherein the retracting means is a spring and a twisting element to alter a tension of the spring.

15. A horse bit comprising:

a. a mouthpiece;

b. a pair of cheek pieces, wherein each cheek piece comprises:

i. a central cheek piece connected to the mouthpiece, wherein the central cheek piece comprises a cheek pivot hingedly attached to a cheek lever that allows the cheek piece to be in a first position or a second position, wherein when the cheek piece is in the first position, the horse bit acts as a direct pressure bit, and wherein when the cheek piece is in the second position, the horse bit acts as a leverage bit, ii. an upper attachment point connected to a top of the central cheek piece to connect to a bridle cheek piece, and iii. at least one lower attachment point connected to a bottom of the central cheek piece to connect to reins;

c. a spring that biases the cheek piece to the first position, wherein the spring is attached from the cheek pivot to the cheek lever;

d. wherein the horse bit acts as a loose ring snaffle when the cheek piece is in the first position;

e. wherein the horse bit acts as an elevator bit when the cheek piece is in the second position; and f. wherein the central cheek piece further comprises a locking mechanism operable to lock the cheek piece in the first position or the second position.

16. The horse bit of claim 15 further comprising a curb chain connected to the upper attachment point of each cheek piece.

* * * * *